United States Patent [19]

Lieberman

[11] 4,150,264

[45] Apr. 17, 1979

[54] REMOTELY CONTROLLED ELECTRIC SWITCH

[75] Inventor: Gilbert Lieberman, Hampstead, Canada

[73] Assignee: Gilbert Products Incorporated, Montreal, Canada

[21] Appl. No.: 902,227

[22] Filed: May 2, 1978

[51] Int. Cl.[2] ..... H01R 13/70; H01H 35/38

[52] U.S. Cl. ..... 200/51 LM; 200/81 H; 200/82 R; 200/153 LB

[58] Field of Search ..... 200/81 H, 331, 51 LM, 200/82 R, 83 R, 336, 153 LB, 51.13, 51.08

[56] References Cited

U.S. PATENT DOCUMENTS

| | | | |
|---|---|---|---|
| 1,354,999 | 10/1920 | Pieri | 200/81 H |
| 2,866,024 | 12/1958 | Ginn | 200/153 LB |
| 3,123,686 | 3/1964 | Leichsenting | 200/51 LM |
| 3,488,464 | 1/1970 | Hocking | 200/81 H |
| 3,674,967 | 7/1972 | Walker | 200/153 LB |
| 3,902,028 | 8/1975 | Tremain | 200/83 R |

FOREIGN PATENT DOCUMENTS 1144780 4/1957 France.

*Primary Examiner*—Steven L. Stephan
*Attorney, Agent, or Firm*—Browdy and Neimark

[57] ABSTRACT

A remotely controlled pneumatically operated switch consisting of a pneumatic actuator and a mechanical switch assembly and interconnecting pneumatic tubing. The switch assembly has extending contact blades for insertion into an electrical receptacle, and also has slot recesses for receiving the contact blades of an electrical plug. The switch is opened or closed by the action of a rotatable cam on an electrically conductive spring arm. The assembly provides for convenience in switching and also provides a safety factor to the user.

9 Claims, 7 Drawing Figures

REMOTELY CONTROLLED ELECTRIC SWITCH

The present invention relates to a remotely operated electric switch, and more particularly, to an electric switch assembly which is actuated from a position remote from the switch by means of pneumatic pressure.

PURPOSE AND GENERAL DISCUSSION OF THE INVENTION

It is often desirable to be able to control electric current flow from a position a distance from the electrical circuitry both for purposes of convenience and safety.

Wall positioned electric receptacles are live (unless they are controlled by a wall switch) and when one utilizes live wall receptacles to supply electric current to an appliance or a device such as Christmas tree lights, or the like, which themselves do not have their own switching means, it is necessary to insert or remove the plug from the receptacle to control current flow to the device. This can be most inconvenient if for example the wall outlet is in a position behind an article of furniture, or behind a Christmas tree or the like, and one purpose of the present invention is to provide a remotely controlled pneumatically operated electrical switch which itself plugs into a receptacle, and receives the plug of the device which it is desired to control. In this way, the pneumatic operating element which may be in the form of a pneumatic bulb may be positioned at any suitable spaced location to simplify switching.

The present switching arrangement may conveniently be used in many applications, and it is particularly well suited for use by bed-ridden patients as a means of controlling lamps, radios, and television and the like, without the patient having to exert himself to reach a distant switch. When used in this fashion, the pneumatic squeeze bulb of the assembly is simply placed at a convenient position on or adjacent the bed so that it is always in easy reach of the bed-ridden person.

In addition to the convenience involved, the present invention also provides a safety factor which can never be achieved by a switch which is placed in proximity to live electrical wires. The pneumatic actuator and the tubing which extends from the actuator to mechanical switching means are electrically non-conductive, and a person actuating the electrical switch from a remote position is completely safeguarded against the possibility of any electrical shock. With the present device, it is possible to safely disconnect electrical current flow without any risk of electrical shock whatsoever even though the actual switching movement itself may be in an extremely hazardous position such as being extremely wet, or in fact, completely under water.

In general terms the present device consists of a casing which houses mechanical switching means, and which is provided with two extending contact blades, and also preferably a ground blade, and is provided with slot recesses for receiving the blade contacts of a common electrical plug with or without a ground. The casing carries spring arm contact means which bears on a cam which is rotatable by the action of a plunger which is actuated by pneumatic flow caused by pressure of the pneumatic bulb. Pneumatic tubing which is of electrical non-conductive material such as rubber or suitable plastics material extends from the switch to the pneumatic bulb and this tubing can of course be of any suitable length depending upon the particular application of the device. By depressing the pneumatic bulb, the plunger causes the cam to rotate one segment of rotation and successive squeezing of the pneumatic bulb moves the spring arm to off and on positions as required. Assuming the switching assembly to be off, one squeeze of the bulb causes the plunger to rotate the assembly so that electrical contact is made, with a subsequent squeeze of the bulb then again breaking the electrical circuitry.

OBJECTS OF THE INVENTION

It is the principle object of the present invention then to provide an electric switch which for convenience and safety is remotely controlled by using pneumatic pressure, and which is reliable in operation and durable in construction.

These objects are achieved by the present invention which specifically provides a remotely controlled pneumatically operated electrical switch comprising a pneumatic actuator and a mechanical switch assembly and pneumatic tubing extending therebetween. The mechanical switch assembly has a housing made of electrically non-conductive material with first and second contact blades extending therefrom, and with first and second slot recesses for receiving contact blades of an electric plug of a device to be switched. A contact in the second slot recess is in contact with the said second extending contact blade. A cam wheel made of electrically non-conductive material is rotatably carried by the housing and is adapted to be rotated by a plunger rod operable by the pneumatic actuator. An electrically conductive spring arm has one end in electrical contact with a contact provided in the first slot recess and a first electrical contact point is provided on the other end of the spring arm, and a second electrical contact point is in electrical connection with the said first extending contact blade. The spring arm is spring biased away from contact between the said first and second electrical contact points and bears against a cam provided on the cam wheel which has sequentially high and low cam surfaces whereby rotation of the cam wheel moves the first electrical contact point into and out of contact with the second contact point.

BRIEF DESCRIPTION OF ACCOMPANYING DRAWINGS

Figure 3A:
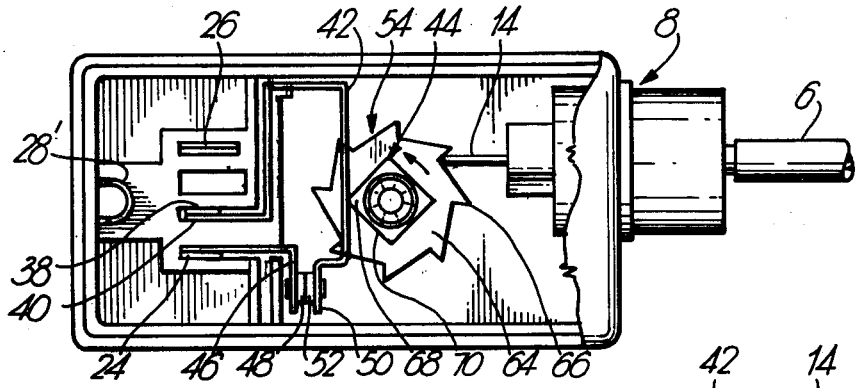
Figure 3B:
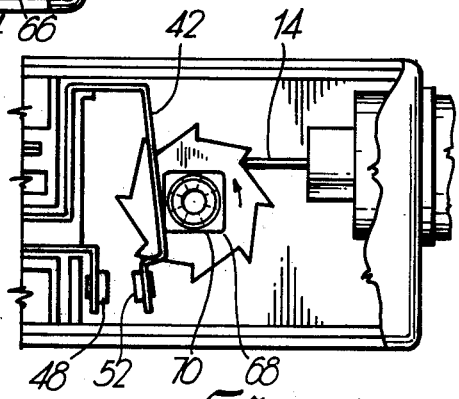
Figure 4:
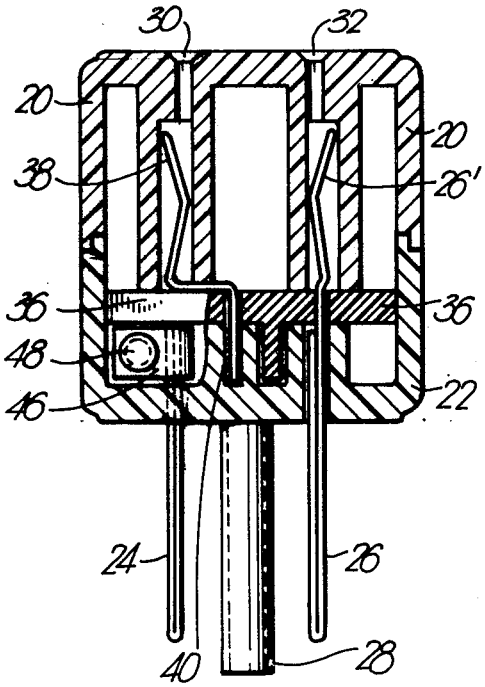
Figure 5:
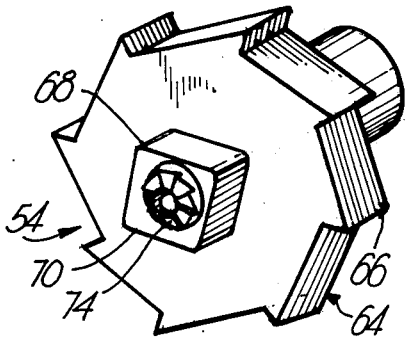
Figure 6:
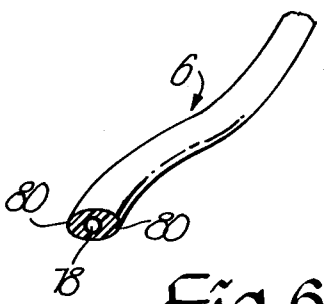
Figure 2:
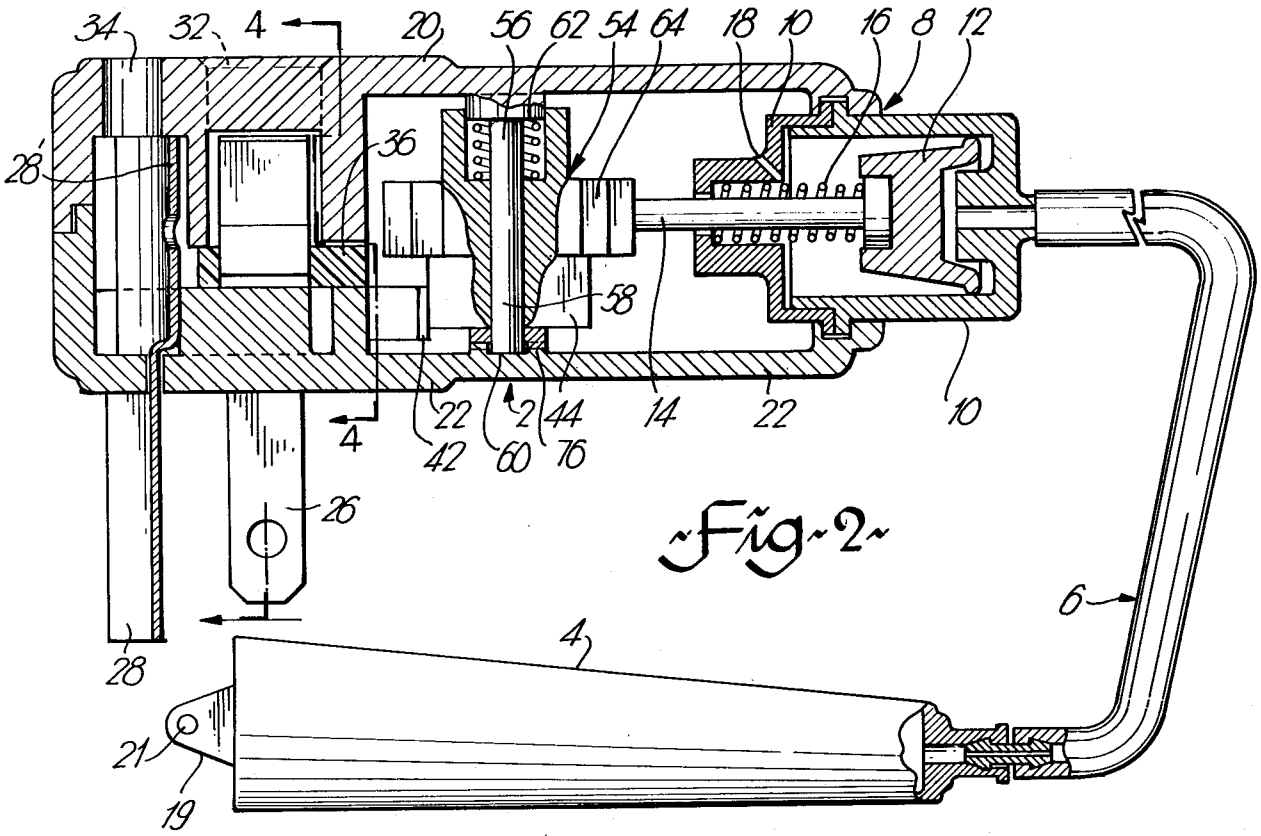
FIG. 2 illustrates in partially sectioned side view the mechanical switch and the remote pneumatic actuator and interconnecting pneumatic tubing and is a view taken generally along the line 2—2 of FIG. 1.

FIG. 3*a* is a top sectional view of the mechanical switch showing an electrical contact in closed position;

FIG. 3*b* is a view similar to FIG. 3*a* but showing the electrical contact in open position;

FIG. 4 is an end sectional view of the switching assembly taken along line 4—4 of FIG. 2;

FIG. 5 is a perspective view of a rotatable cam wheel used in the mechanical switching component; and FIG. 6 is a cross-sectional view of one form of pneumatic tubing which is preferred for use, and appears on the sheet with FIG. 2.

DETAILED DESCRIPTION OF ACCOMPANYING DRAWINGS

Figure 1:
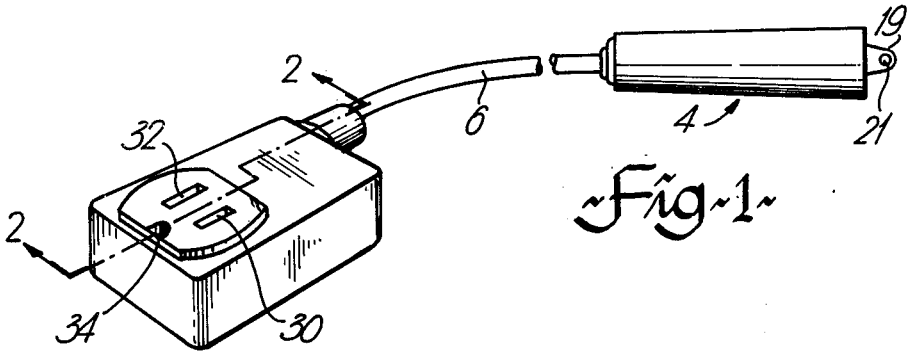
FIG. 1 shows in perspective view the remotely operated switch assembly according to the present invention.

The invention consists of three basic components and with reference to FIGS. 1 and 2, numeral 2 generally indicates a mechanical switching assembly, numeral 4 indicates a pneumatic actuator which may be in the form of a squeeze bulb, and numeral 6 indicates interconnecting pneumatic tubing.

The pressure bulb 4 is of usual construction, being hollow and made of resilient material, whereby squeezing pressure on the bulb results in air under pressure being forced out of the bulb down the hollow interior of the tubing 6 to a pneumatic actuator assembly shown generally at 8 in FIG. 2 and which forms part of the mechanical switch assembly. The assembly 8 consists of a casing 10 (which is in two parts as shown) which carries a piston 12 secured to a piston rod 14 which projects outwardly from the casing 10 as shown.

As will be appreciated, depression of the pressure bulb 4 will cause movement of the piston 12 and piston rod 14 to the left as shown in FIG. 2. A return spring 16 provided around the piston rod 14 assists in returning the piston 12 to the position shown in FIG. 2 upon relaxation of pressure on the bulb. An air vent 18 provided in casing 10 permits venting of air.

The pressure bulb 4 may be of any suitable construction and configuration. The bulb 4 can for example be generally round or could be configured for lying on the floor so that the bulb could conveniently be depressed simply by foot contact. The bulb 4 may also be provided with a tab 19 having an aperture 21 for hanging the bulb in an elevated position for convenience.

The casing or housing of the mechanical switching assembly (which assembly is shown generally by numeral 2) is for purposes of assembly provided as upper 20, and lower 22, portions which are secured together by any suitable means. The casing 10 of the pneumatic actuator assembly may conveniently be captively secured in position by closure of the casing halves 20 and 22 as shown in FIG. 2.

The assembly 2 is provided with two extending contact blades 24 and 26 and also preferably with a grounding prong 28 as shown. The contact blades 24 and 26 (and also prong 28 if present) are adapted to be received in an electric plug receptacle; and in accordance with suggested C.S.A. (Canadian Standards Association) and U.L. (Underwriters' Laboratories) specifications when the blades are inserted into a regulation receptacle (not shown), blade 24 will come into contact with the positive or live electrical contact in the receptable, and blade 26 will contact the neutral contact, and prong 28 will be positively grounded.

As shown in FIGS. 1, 2, and 3, the upper portion 20 of the switch casing is provided with slot recesses 30 and 32 to receive the contact blades of a plug (not shown) in the circuit which is to be switched, and provision is also preferably made at 34, to provide for grounding. When the plug of the wiring of the load which is to be switched is inserted into slots 30, 32, and 34, the ground projection on the plug enters slot 34 and moves downwardly where it makes contact with the grounding prong extension 28' provided internally in the casing as will be well understood from FIG. 2.

One contact blade of the plug enters recess 32 and during its positioning therein it comes into electrical contact with the inner end 26' of contact blade 26 as clearly shown in FIG. 4, thus ensuring electrical contact with extending neutral blade 26. The casing portions 20 and 22 are made of suitable material which is electrically non-conductive, and the blade 26 (and extension 26') is carried in the housing by a suitable support plate 36 which is also of electrical non-conductive material.

The other contact blade carried by the plug of the circuit which is to be switched, when it is inserted in the slot recess 30 provided in the casing portion 20 comes into electrical contact with a contact 38 which is also carried by the support plate 36—see FIG. 4. As shown in FIG. 3*a*, the contact 38 is in electrical contact with one end 40 of an electrically conductive spring arm 42 which is spring biased for contact with a cam shown generally by numeral 44 in FIG. 3, and in more detail in FIGS. 2 and 5. The inner end of contact blade 24 is in contact with a flange 46 which carries a first contact point 48, and the free end 50 of spring arm 42 is provided with a second contact point 52, all as clearly shown in FIGS. 3*a* and 3*b*. From the above, it will be understood that when the contact points 48 and 52 are in contact, an electrical connection will then exist between contact blade 24 and inner contact 38.

The opening and closing of contact points 48 and 52 is accomplished by the cam 44 which is carried by and formed integrally with a cam wheel 54 shown in perspective view in FIG. 5 and in partially sectioned views in FIGS. 2, 3*a* and 3*b*.

The cam wheel 54 is rotatably mounted between the casing halves 20 and 22 and has an axial opening (not numbered) to receive a shaft 56 carried by casing portion 20. When the halves 20 and 22 are placed together the end 58 of stud 56 is received within a depression 60 provided in casing half 22 as clearly shown in FIG. 2. The shaft 56 thus provides a stationary axis about which the cam wheel 54 rotates.

A spring 62 is provided to snugly hold the cam wheel in rotatable position and bearing against casing half 22.

The cam wheel which is made of electrically non-conductive material, is provided with a central circumferentially toothed portion 64 having individual teeth 66 as clearly shown in FIGS. 3 and 5. The teeth 66 are in the path of movement of the outer end of piston rod 14 (see FIGS. 2 and 3) and it will be appreciated that for each forward extension of piston rod 14 that the cam wheel will be rotated one segment of a revolution.

The cam wheel 54 is integrally provided with the squared cam 44 and the spring arm 42 rides on the squared cam surfaces and sequential segments of rotation of the cam wheel 54 will cause the spring arm 42 to move from contact with corners of the squared cam surface to contact with a flattened side surface as will be appreciated from FIGS. 3*a* and 3*b*.

FIG. 3*a* shows the position of spring arm 42 when it is contacted by a rounded corner 68 of the squared cam 44 and in which position the electrical contacts 48 and 52 are together. One segment of rotation of the cam wheel 54 moves the squared cam to the position shown in FIGS. 3*b* and the spring arm 42 (which is spring-biased to assume an open-contact position) then contacts a side 70 of the squared cam and assumes the position shown in FIG. 3*b* wherein contact 52 is spaced from contact 48 and the switch is open.

In the drawings the cam wheel 54 has eight circumferentially spaced teeth 66 and the squared cam 44 has eight cam or bearing points—the four sides 70 and the four corners 68. Thus for each complete rotation of the cam wheel the contact points 48 and 52 contact each other four times and are opened four times.

It will be appreciated that the squared cam 44 could have a polygonal configuration other than square and be for example five, six or more sided and the number of teeth 66 would then be double the number of cam or bearing points to provide for proper indexing of the cam points with the spring arm 42.

As shown in FIG. 5, a cylindrical projection 72 integral with the cam wheel 54 has a ratchet-shaped configuration with teeth and inclined bearing surfaces shown generally at 74. Eight such teeth and surfaces are shown in FIG. 5. An equal number of teeth with oppositely inclined bearing surfaces are provided on the top circular surface of a projecting collar 76 formed in casing half 22 and these opposed ratchet surfaces are held in snug bearing relationship by the action of spring 62. For each forward extension of the piston rod 14 the gear wheel 54 will rotate one segment of rotation and the ratchet arrangement 74 will advance one full step with respect to the ratchet arrangement provided on projecting collar 76. Due to the action of spring 62 and the oppositely inclined bearing surfaces the wheel 54 will always become precisely oriented with respect to casing 22 thus ensuring proper indexing of the bearing points on the cam 44 with respect to the spring arm 42.

While the contact points 48 and 52 may be made of brass or other suitable conductive alloys, it is preferred that they be surfaced with material such as a silver or gold alloy, or the like to increase the switch rating. Additionally, such layering results in a substantial decrease in electrical arcing during "make and break" of the switch to minimize contact pitting and wear and substantially increase the life of the switch assembly.

The pneumatic tubing 6 which is used can be the well known vacuum or pressure tubing and any suitable tubing can be used without departing from the scope of the invention.

However, in preferred construction, the tubing employed is of a sectional shape as shown in FIG. 6 and which is of generally elliptical cross-section having a central or axial circular opening 78. The tubing 6 as shown in FIG. 6 is of generally elliptical or oval configuration having excess material 80 extending longitudinally along both sides which provides anti-collapse support to the tubing and prevents closing of the central opening if the tubing is inadvertently stepped upon or if some heavy object such as a chair or table or bed is inadvertently placed on it.

The foregoing description and accompanying drawings suggest that the pneumatic actuator may be in the form of a pressure or squeeze bulb and this is one preferred embodiment. However, it will be appreciated that actuation of the switch may be accomplished by pneumatic pressure other than from a pressure bulb and the source of pneumatic pressure may be a compressed air supply with switching of the device being accomplished by trigger or valve means. By using a supply of compressed air or gas the length of tubing can be extended and actuation of the switch accomplished from much greater distances. Accordingly, and in the present specification the term pneumatic actuator is intended to include pressure bulbs, compressed gas or air supply and all other structures and devices which will on demand deliver actuating pressure to the switch.

I claim:

1. A remotely controlled pneumatically operated electrical switch, comprising:

a pneumatic actuator;

a mechanical switch assembly; and pneumatic tubing extending between said pneumatic actuator and said mechanical switch assembly, wherein said mechanical switch assembly comprises - a housing made of electrically non-conductive material having first and second contact blades extending therefrom, first and second slot recesses for receiving contact blades of an electric plug of a device to be switched, and a contact in the second slot recess in contact with the said second extending contact blade, a plunger rod operable by said pneumatic actuator by way of said pneumatic tubing, a cam wheel made of electrically non-conductive material rotatably carried by said housing and adapted to be rotated by said plunger rod, said cam wheel having a cam with sequentially high and low cam surfaces, an electrically conductive spring arm having one end in electrical contact with a contact provided in said first slot recess, a first electrical contact point on the end of said spring arm opposite that end in electrical contact with said first slot recess, and a second electrical contact point in electrical connection with the said first extending contact blade, wherein said spring arm is spring biased away from contact between the said first and second electrical contact points and bears against said cam provided on said cam wheel, whereby rotation of said cam wheel moves said first electrical point into and out of contact with said second contact point.

2. A switch according to claim 1, wherein said mechanical switch assembly housing includes a third extending contact blade which provides a grounding contact, and a third slot recess associated with the third contact blade.

3. A switch according to claim 1, wherein said cam wheel has teeth provided circumferentially therearound, the teeth being sequentially contacted by said plunger upon depression of said pneumatic actuator to effect rotation of said cam wheel.

4. A switch according to claim 1, wherein said cam is of square configuration having rounded corners and is molded integrally with said cam wheel.

5. A switch according to claim 4, wherein the rounded corners on said cam provide the high cam surfaces and the sides of the square configuration provide the low cam surfaces.

6. A switch according to claim 1, wherein said cam wheel has an axial opening receiving a shaft carried by said housing, said cam wheel rotating around said shaft.

7. A switch according to claim 1, wherein one end of said cam wheel is provided with a ratchet arrangement comprising teeth and inclined bearing surfaces in contact with a reverse ratchet arrangement provided in said housing, and wherein said mechanical switch assembly further includes a spring acting on said cam wheel for urging said ratchet arrangements together.

8. A switch according to claim 1, wherein said pneumatic actuator is in the form of a pneumatic bulb, each depression of said pneumatic bulb causing movement of said cam wheel one segment of rotation, movement of said cam wheel in sequential segments of rotation acting on said spring arm to make and break electrical contact between said first and second electrical contact points.

9. A switch according to claim 1, wherein said pneumatic tubing is of elliptical or oval cross-sectional configuration having a central circular opening extending longitudinally therethrough, the thickness of material along the major axis of the ellipse acting to prevent closure of the circular opening.

* * * * *